United States Patent [19]

Chang

[11] Patent Number: 4,762,321

[45] Date of Patent: Aug. 9, 1988

[54] FOLDAWAY TABLE TENNIS SUPPORT STRUCTURE

[76] Inventor: Yong-Hong Chang, No. 53-5, Fu Hsing Village, Chi An Hsiang, Hwa Lien Hsien, Taiwan

[21] Appl. No.: 53,618

[22] Filed: May 26, 1987

[30] Foreign Application Priority Data

Nov. 25, 1986 [JP] Japan ..... 61-181022[U]

[51] Int. Cl.[4] ..... A63B 39/00

[52] U.S. Cl. ..... 273/30; 108/115; 108/144; 108/160

[58] Field of Search ..... 273/30; 108/115, 116, 108/117, 121, 124, 126, 129, 130, 131, 134, 160; 297/159

[56] References Cited

U.S. PATENT DOCUMENTS

| | | | |
|---|---|---|---|
| 2,632,546 | 3/1953 | Mott | 273/30 |
| 2,723,122 | 11/1955 | Jaysane | 273/30 |
| 3,190,649 | 6/1965 | Heisler | 273/30 |
| 3,754,760 | 8/1973 | Nielsen | 273/30 |
| 3,777,674 | 12/1973 | Person | 273/30 |
| 3,830,495 | 8/1974 | Hill | 273/30 |
| 4,089,522 | 5/1978 | Rock | 273/30 |

*Primary Examiner*—Richard C. Pinkham
*Assistant Examiner*—Theatrice Brown
*Attorney, Agent, or Firm*—Bacon & Thomas

[57] ABSTRACT

A folding tennis table having a pair of planar surfaces, each being one half of the table playing surface. The halves are hingedly connected at adjacent edges by support structure. The support structure is comprised of four brackets, two brackets being placed on the lower surface of each table half. A brace is retained between a pair of brackets, one bracket being on each surface. An extension bar is pivotably attached to each brace and a leg frame. The leg frame is hollow and has a leg telescopically extending therethrough. The leg is provided with a swivel bar so as to be pivotably attached to allow the table to be folded in one step.

1 Claim, 6 Drawing Sheets

FOLDAWAY TABLE TENNIS SUPPORT STRUCTURE

BACKGROUND OF THE INVENTION

This inventin relates to a comprehensive folding support structure for a table tennis table and net. Previous table tennis tables and nets often had the problem that, after a short period of use, the two sides of the table would become uneven relative to each other or the folding mechanisms were easily bent or broken.

It is the purpose of this present invention, therefore, to mitigate and/or obviate the abovementioned drawbacks in the manner set forth in the detailed description of the preferred embodiment.

SUMMARY OF THE INVENTION

A primary objective of this invention is to provide a table tennis table and structure which will remain level after extended usage.

Another objective of this invention is to provide a table tennis table and structure which is easily foldable.

A further objective of this invention is to provide a table tennis table and structure in which the net does not have to be removed to fold the table.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
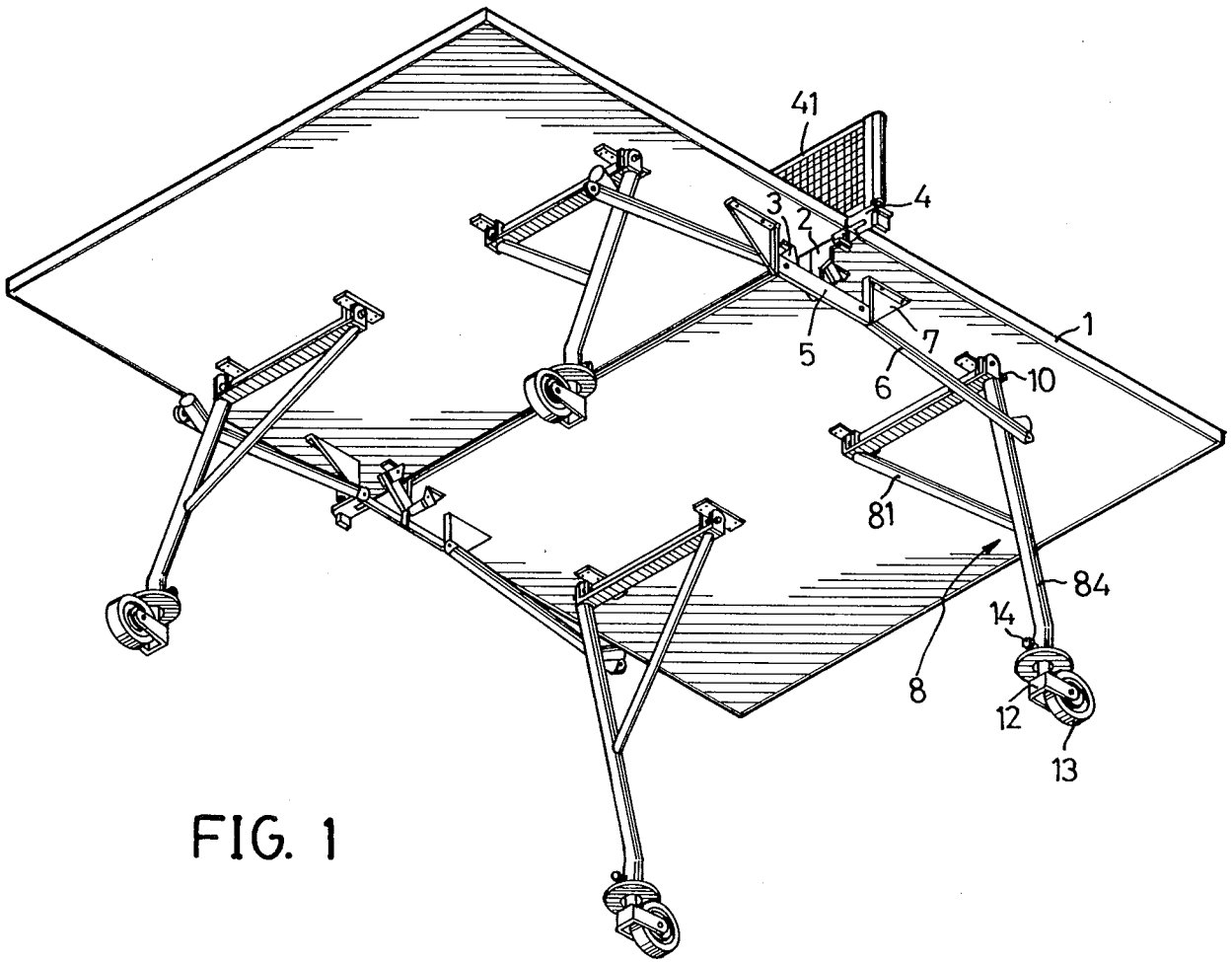
FIG. 1 is a perspective view of a foldaway table tennis support structure according to the present invention, as viewed from below.

Referring to FIG. 1, it can be seen that each side of the present invention comprises two brackets 7 which are connected by a brace 5, two extension bars 6, two pivotal leg frames 8 with a stabilizing bar 81 thereon, roller wheels 13, and of course a table top 1 and a net 41.

Figure 2:
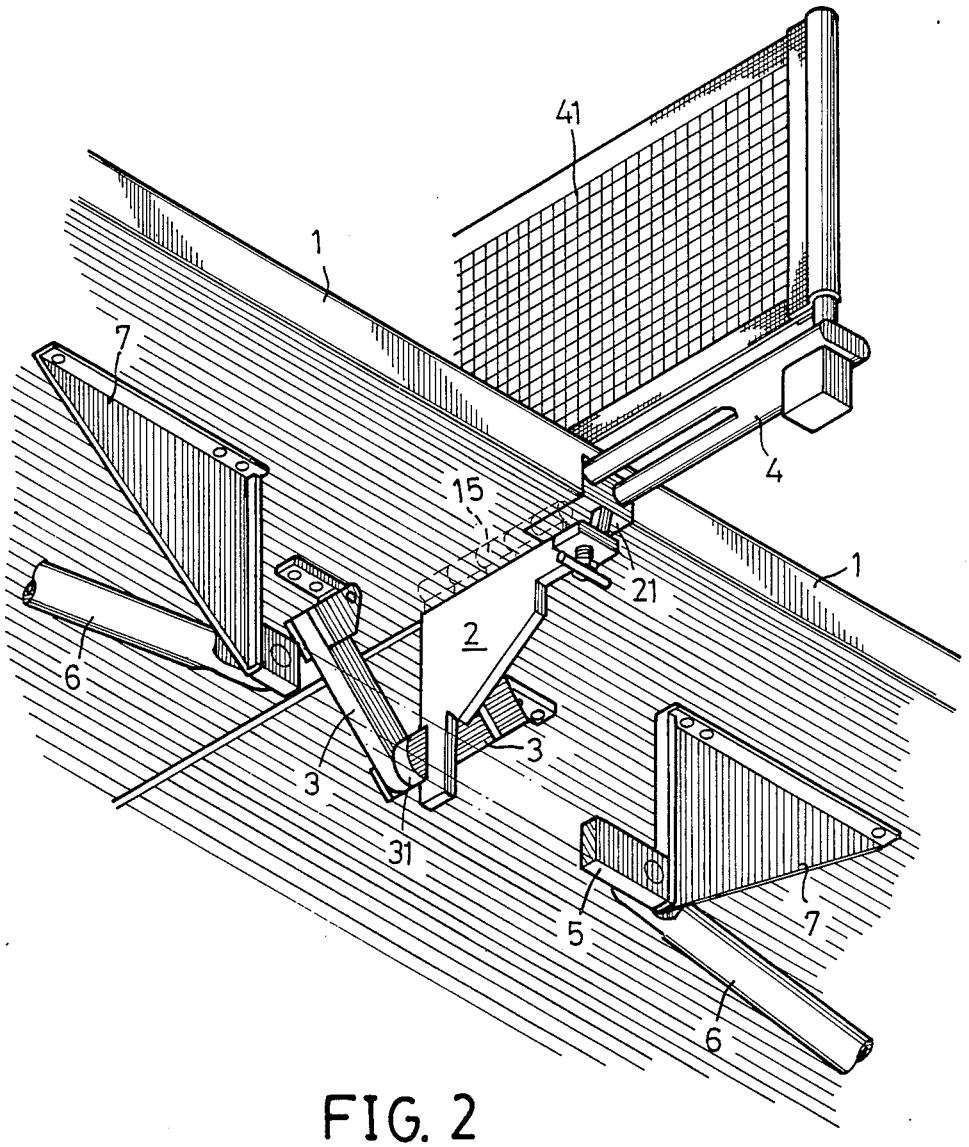
FIG. 2 is a perspective view of a bracket area of a support structure in accordance with the present invention.
Figure 6:
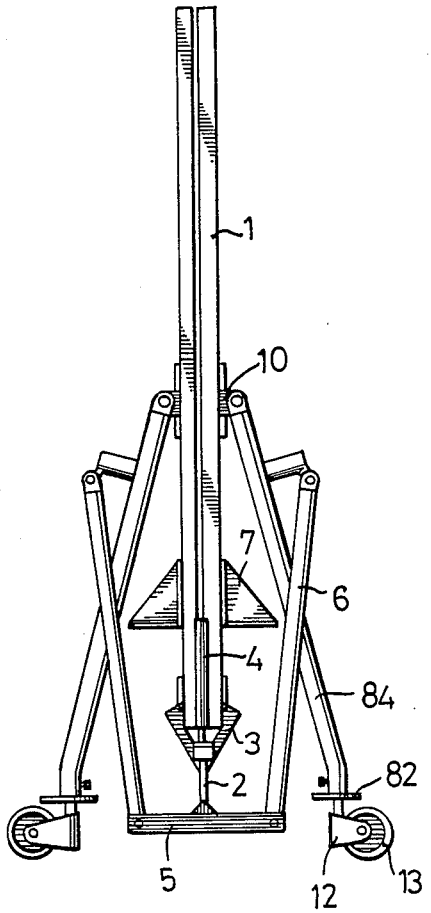
FIG. 6 is an elevational view of a table tennis table and support structure in folded position in accordance with the present invention.

In FIG. 2, the central section of the table tennis structure and table according to the present invention can be seen. The table top 1 itself is hinged from within by hidden hinges 15 so that the top surfaces of each of the leaves of the table top 1 face each other when the table tennis structure is put in folded position (as seen in FIG. 6).

Each of the brackets 7 is fixed to the lower part of the table top 1 with the distal ends of a brace 5 touching and being stabilized by said brackets 7, but not being fixed thereto. The brackets 7 serve to keep the brace 5 exactly centered while at the same time allowing ease of foldability. The brace 5 itself is pivotally connected to an extension bar 6 on each distal end thereof. The bar 6, in turn, pivotally connect to the leg frame 8, as will be discussed in more detail later.

The pivot 3 of the present invention can also be clearly seen in FIG. 2. The pivot 3 has two legs which are joined together at pivot joint 31. The two legs are each pivotally secured to the table top 1 so that when the table tennis structure of the present invention is in folded position, the two legs of the pivot add structural integrity to the table, so that all the stress between the two faces of the table top is not concentrated at the hinges 15. The pivot 3 also helps to keep the two faces of the table top 1 level. In addition, one of the legs of the pivot 3 supports the slide mount 2, which in turn supports a slide block 21. The slide block 21 has two parallel holes spanning across its length. A slide 4 with two slide rails corresponding to the holes in the slide block 21 can be seen. This slide 4 allows the net 41 to be slidably adjusted so that the tension of the net can be controlled.

Figure 3:
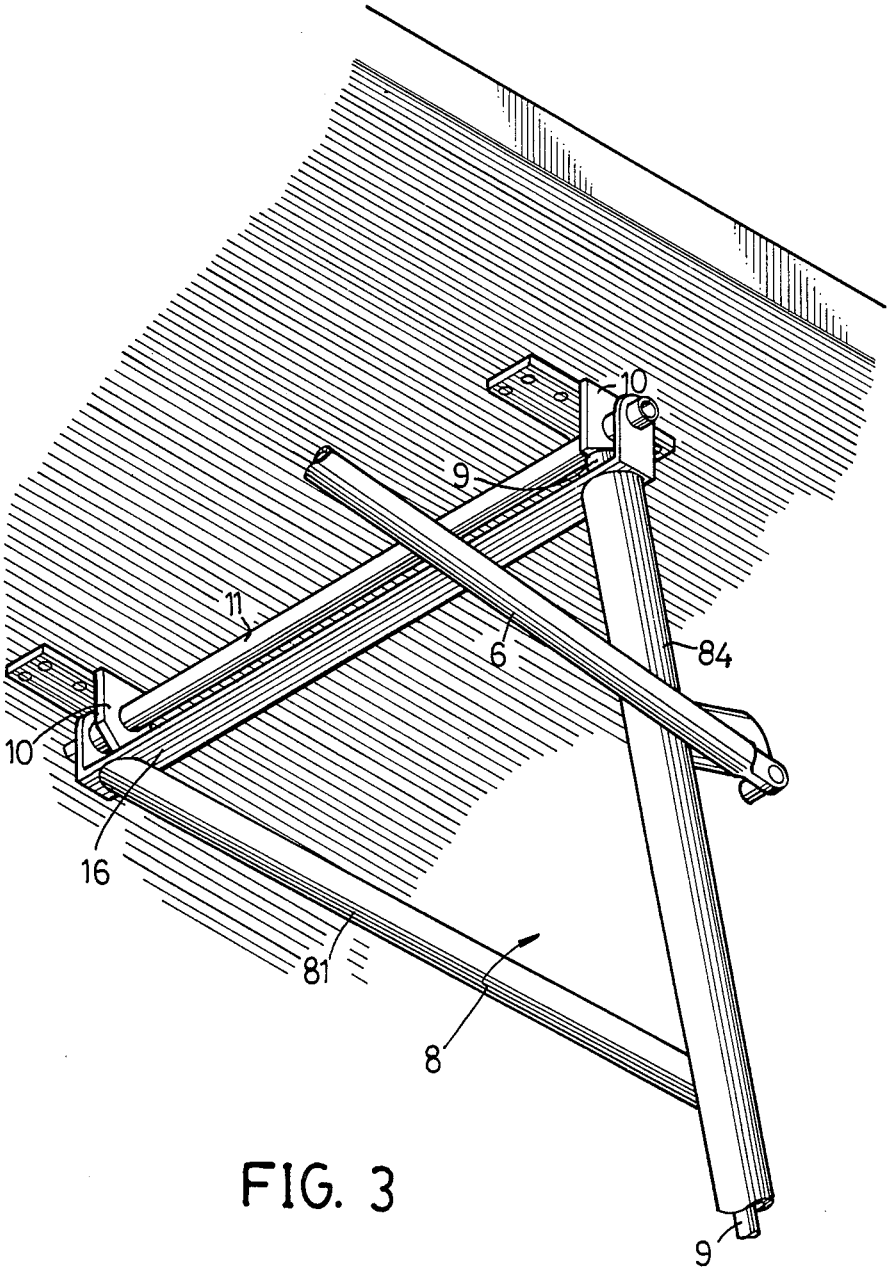
FIG. 3 is a perspective view of a leg frame and associated parts in accordance with the present invention.

An extension bar 6 is pivotally connected to each distal end of the brace 5. The other end of each of the extension bars 6 is pivotally connected to a corresponding leg frame 8, as can be seen in FIG. 3. The extension bar ensures that the leg frame is at the proper distance from the brace 5 and hence at the optimum orientation. Please note that the position of the brace 5 is fixed by the two brackets 7, therefore the unfolded position of the extension bar 6 and the leg frame 8 are also fixed.

Each of the leg frames 8 comprises a long hollow tube or hollow leg 84 having a leg 9 slidably mounted therein. The leg 9 is fixed to a swivel bar 11 which, in turn, is rotatably mounted in a corresponding hole in a wedge 10. The wedge, of course, is fixed to the lower face of the table top 1. The swivel support 16 of the leg frames 8 is pivotal about the swivel bar 11 at a position near to each of the wedges 10. A stabilizing bar 81 spans between the inner end of the swivel support 16 and the hollow leg 84 of the leg frame 8. This stabilizing bar offers lateral support to the table top so that the table will not have any tendency over the long run to sway.

Figure 4:
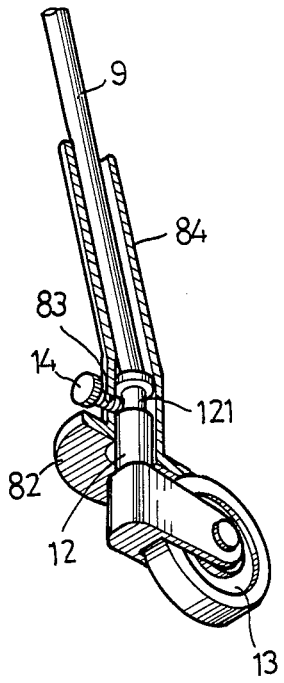
FIG. 4 is a partially cutaway perspective view of a lower part of a leg frame in accordance with the present invention, showing the roller and associated parts.

Now referring to FIG. 4, the lower portion of the leg frame 8 and the corresponding components therein can be seen. As mentioned above, the leg 9 is free to slide in the leg frame 8. At the lower end of the leg frame 8 is a foot 121, which is both a part of the shank 12 which supports the roller 13 and which allows for the adjustability of the height of the table by height adjustment screw 14, which is threaded through a threaded hole 83 in the leg frame 8. This screw 14 may be loosened to allow the leg 9 to slide up or down and then tightened against the foot 121 at the desired table height. The roller 13, in and of itself, is not a novel feature and will not be discussed further. FIG. 4 also shows a collar 82, which protects the roller from being easily bent or distorted.

Figure 5:
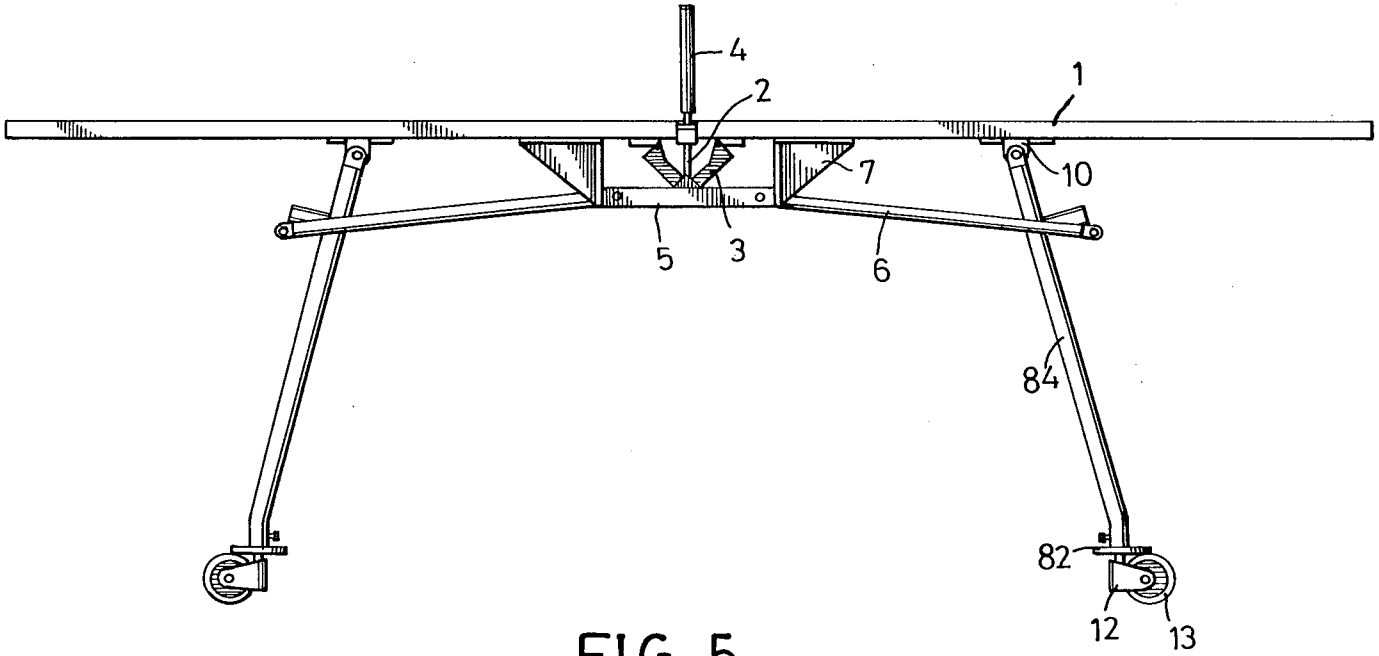
FIG. 5 is a side elevation view of a table tennis table support structure in accordance with the present invention.

FIG. 5 shows the table tennis table structure of the present invention in unfolded, or open, position. When it is desired to fold the table, the user simply pushes up on one end of the table. As the user pushes up, the rollers remain on the ground since the legs 9 (inside leg frame 8) are pivotable and since the middle portion of the table top 1 is pivotable about the pivot 3. In addition, the pivot 3 pulls down on the other face of the table top 1 so that the user can essentially close the table in one step. Note that since the brackets 7 and the brace 5 are not directly connected, but only stabilize each other, that when the table is folded, there is no resistance to folding offered therefrom.

FIG. 6 shows the table tennis table structure of the present invention in folded position. Note that the net need not be removed to fold the table, and in fact remains supported by the slide mount 2, which in turn is supported by the extension bars 6.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A foldaway table tennis support structure comprising:

(a) four brackets (7) which are fixed to the lower surface of a substantially horizontal table top (1) comprised of two leaves; two of said brackets (7) attached to each of said leaves, said brackets facing each other;

(b) two braces (5); each of said braces extending between and engaging two of said brackets (7) and being stabilized thereby;

(c) four extension bars (6); said extension bars each having one of its ends pivotally attached to one end of said brace (5) and having a leg frame (8) pivotally attached to its other end;

(d) said leg frame (8) comprising a long hollow leg (84), a swivel support (16) and a stabilizing bar (81) extending between said hollow leg and said swivel support for lateral support of said table top;

(e) each leg frame having a pair of wedges (10) which are fixed to the lower surface of each leaf of said table top (1); each of said wedges (10) having a hole therethrough;

(f) each of said leg frames having a swivel bar (11); said swivel bar (11) being pivotally retained in said holes of said wedges (10); said swivel support (16) being pivotally attached to one of said swivel bars (11); and (g) each said hollow leg (84) having a leg (9) telescopically received therein; said legs (9) being slidable within said hollow legs (84) for adjusting the height of said table and a roller (13) on the lower end thereof, adjustment means on the lower end of each hollow leg for engaging and adjustably fixing said leg (9) relative to said hollow leg (84).

* * * * *